United States Patent [19]

Kagoura

[11] 4,120,525

[45] Oct. 17, 1978

[54] LATCH ASSEMBLY

[75] Inventor: Tetsuro Kagoura, Kurobe, Japan

[73] Assignee: Yoshida Kogyo K.K., Tokyo, Japan

[21] Appl. No.: 782,507

[22] Filed: Mar. 29, 1977

[30] Foreign Application Priority Data

Mar. 3, 1976 [JP] Japan ..... 51/41104[U]

[51] Int. Cl.[2] ..... E05C 13/00

[52] U.S. Cl. ..... 292/336.3; 292/358

[58] Field of Search ..... 292/207, 208, 347, 358, 292/DIG. 27

[56] References Cited

U.S. PATENT DOCUMENTS

| | | | |
|---|---|---|---|
| 1,387,888 | 8/1921 | Holt | 292/DIG. 27 |
| 2,412,789 | 12/1946 | Voight | 292/359 |
| 3,877,739 | 4/1975 | Cowen | 292/101 |

*Primary Examiner*—Richard E. Moore

*Attorney, Agent, or Firm*—Hill, Gross, Simpson, Van Santen, Steadman, Chiara & Simpson

[57] ABSTRACT

A latch assembly comprises a bolt unit mounted in a frame member of a door or window sash, and a bolt-driving unit installed on one side of the door or window sash. The bolt unit has a latch bolt supported by a rotatable hollow shaft, the bolt being pivotable between projecting and retracted positions by rotation of the hollow shaft. The bolt driving unit includes an axially movable driver torque bar having on one end a driver that is normally held in engagement partly with the hollow shaft in driving relation and partly with fixed engaging means of the bolt driving unit against rotation of the torque bar. By pushing the driver torque bar axially toward the hollow shaft, the driver becomes shifted out of engagement with the fixed engaging means, whereupon the driver torque bar can be turned about its own axis by an operator handle in order to rotate the hollow shaft for latching and unlatching operation. The axial movement of the driver torque bar can be effected by a push button mounted in the handle coaxially with the torque bar.

9 Claims, 3 Drawing Figures

LATCH ASSEMBLY

BACKGROUND OF THE INVENTION

Field of the Invention

The present invention relates to a latch assembly for use on a frame member of a window sash or door.

SUMMARY OF THE INVENTION

The latch assembly of the invention includes a bolt unit having a pivotable latch bolt supported by a hollow shaft mounted rotatably in a support frame to be installed in a window sash or door frame member, and a bolt-driving unit having a casing to be attached to the frame member, an operator handle having a shaft disposed rotatably in the casing, and a driver torque bar having one end mounted coaxially in the shaft for corotation therewith and axial movement therein. The driver torque bar has on the opposite end a driver including a portion held in engagement with fixed engaging means on the casing and a portion inserted in the hollow shaft in driving engagement therewith. Upon axial movement of the driver torque bar toward the hollow shaft, the driver is displaced out of engagement with the fixed engaging means, whereupon the driver torque bar becomes free to revolve about its own axis. When the handle is mainpulated to pivot about its shaft, the driver rotates the hollow shaft about its longitudinal axis, and hence the latch bolt about the hollow shaft into or out of a projecting position. A spring-loaded push button is retained in the handle for pushing the driver torque bar toward the hollow shaft.

Accordingly, it is an object of the present invention to provide a latch assembly having a compact mechanism.

Another object of the present invention is to provide a latch assembly comprising unitized component parts.

Another object of the present invention is to provide a latch assembly which can easily be assembled and installed.

A still further object of the present invention is to provide a latch assembly having means for retaining the operator handle and the latch bolt positively in a latched or unlatched position.

Many other advantages and features of the present invention will become manifest to those versed in the art upon making reference to the detailed description and the accompanying sheet of drawings in which a preferred structural embodiment incorporating the principles of the present invention is shown by way of illustrative example.

DETAILED DESCRIPTION OF THE PREFERRED EMBODIMENT

Figure 1:
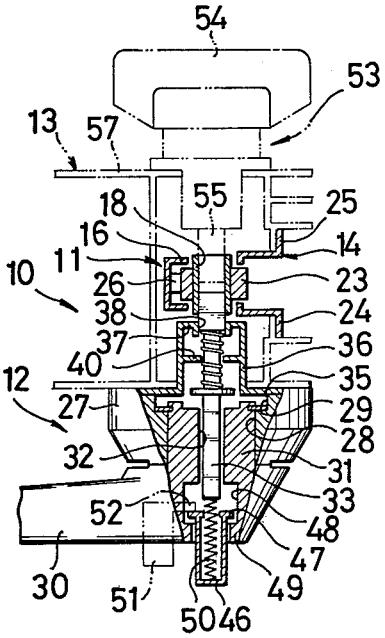
FIG. 1 is a top plan view, partly cut away, of a latch assembly constructed in accordance with the invention, the assembly being installed on a frame member.

The principles of the present invention are particularly useful when embodied in a latch assembly such as shown in FIG. 1, generally indicated by the numeral 10. The latch assembly 10 broadly comprises a latch bolt unit 11 and a bolt-driving unit 12, the units when assembled together being installed, for example, on a vertical frame member or stile 13 of a swinging window sash or door.

Figure 2:
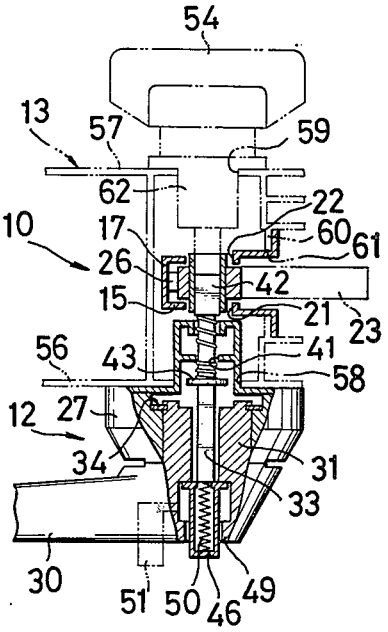
FIG. 2 is a view similar to FIG. 1 but showing the parts in a position ready for actuation.

In FIGS. 1 and 2, the latch bolt unit 11 comprises a support frame 14 of a generally channel-shaped cross-section having a pair of spaced walls 15,16 and an end wall 17 interconnecting the spaced walls 15,16 a hollow shaft 18 of a square cross-section extending across and through the spaced walls 15,16 and having both ends 19,20 supported rotatably in a pair of circular holes 21,22 (FIG. 3) in the spaced walls 15,16 respectively, and a latch bolt 23 fixed at one end to the hollow shaft 18 and extending radially from the hollow shaft 18 or in a direction substantially perpendicularly to a longitudinal axis of the shaft 18. The latch bolt 23 is pivotable or angularly movable substantially 90° between a first or withdrawn position in which the bolt 23 is retracted within the support frame 14 and a second or projecting position in which the bolt 23 has the opposite free end projecting outwardly from the support frame 14, the first position being indicated by the solid lines and the second position by the imaginary lines (FIG. 2). The spaced walls 15,16 have a pair of attachment flanges 24,25, (FIG. 1) respectively, located remotely from the end wall 17, the flanges 24,25 having attachment screw holes (not shown).

A flat spring 26 is mounted on the end wall 17 and acts on the latch bolt 23 for maintaining it in the first position against rattling movement or in the second position against gravity.

The bolt-driving unit 12 comprises a substantially cylindrical casing 27 having a central bore 28 and a counterbore 29, an operator handle 30 having on one end a cylinder shaft 31 rotatably disposed in the bore 28 and a central bore 32 of a square cross-section disposed coaxially in the shaft 31, and a driver torque bar or spindle 33 of a square cross-section having one end axially slidably received in the bore 32 for corotation with the handle shaft 31. The handle shaft 31 has on its free end an annular retainer plate 34 which is held slidably against the bottom of the counterbore 29. Thus, the handle shaft 31 is axially immovable or retained against removal once mounted in the casing 27. The casing 27 has a pair of upper and lower attachment flanges (not shown).

Figure 3:
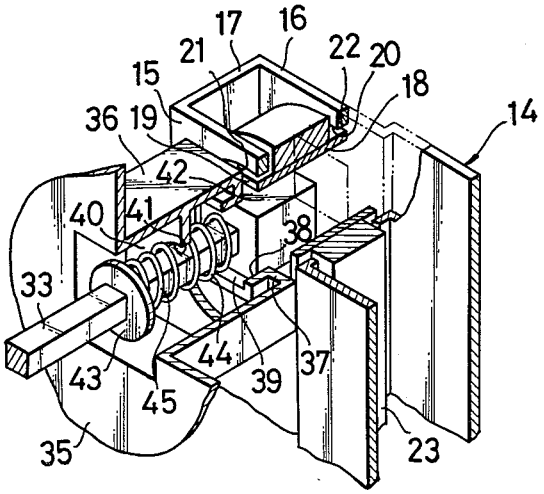
FIG. 3 is an enlarged perspective view, with parts broken away, of a central portion of the latch assembly shown in FIGS. 1 and 2.

Another annular plate 35 is attached to the end of the casing 27 at the counterbore 29, the annular plate 35 supporting thereon a sleeve 36 directed away from and extending coaxially with the central bore 28. The sleeve 36 has on its free end a wall 37 with a flanged edge 38 bounding a central square aperture 39 (FIG. 3). The sleeve 36 also has therein a partition 40 with a central hole 41. The driver torque bar 33 extends through the hole 41 and the aperture 39, and has on the opposite free end a driver 42 of square cross-section so sized that it can slidably fit in the hollow shaft 18 for driving engagement therewith. The driver 42 is normally held in a position in which the driver 42 is slidably inserted partly in the hole 39 in engagement with the flanged edge 38 that acts as fixed engaging means, and is slidably inserted partly in the hollow shaft 18 in driving engagement therewith. In this position, the driver 42 and hence the driver torque bar 33 are retained against rotation. Upon axial movement of the driver torque bar 33 toward the hollow shaft 18, the driver 42 is withdrawn from the aperture 39 or shifted out of engagement with the flanged edge 38. With the driver 42 disengaged from the sleeve 36, the driver torque bar 33 is ready for rotation about its longitudinal axis.

A retainer flange 43 is fixed to the torque bar 33 and confined within the unit 12 to capture the torque bar 33 in the unit 12. A pair of compression coil springs 44,45 are disposed around the torque bar 33, the spring 44 acting between the driver 42 and the partition 40 and the spring 45 acting between the partition 40 and the retainer flange 43. The springs 44,45 are kept in an axial equilibrium such that the driver 42 is held in the square aperture 39 and is thus held against rotation.

To shift the driver torque bar 33 axially toward the hollow shaft 18, a push button 46 is housed in the handle 30 in coaxial relation with the torque bar 33, the push button 46 having a flange 47 trapped in a bore 48 in the handle 30 by means of a rim 49. The push button 46 is hollow but has a closed outer end and contains a compression coil spring 50 acting between the outer end of the hollow push button 46 and the end of the torque bar 33 projecting into the bore 48. The spring 50 normally biases the push button 46 away from the torque bar 33 into engagement with the rim 49. A key-actuated cylinder lock 51 is mounted in the handle 30 and has a retractable stop 52 which upon actuation of the lock 51 projects into the bore 48 for locking engagement with the flange 47 of the push button 46 to prevent or arrest its movement toward the driver torque bar 33.

Another bolt-driving unit 53 having a knob 54 may also be provided on the stile 13, the unit 53 having a driver torque bar or spindle 55, a free end of which is slidably fitted in driving engagement with the hollow shaft 18. For manipulation of the bolt-driving unit 53, the knob 54 is pushed toward the stile 13 to thereby move the torque bar 55 axially until it displaces the driver 42 out of the hollow shaft 18. Then, the knob 54 can be turned to actuate the latch bolt 23 independently of the other bolt-driving unit 12.

The stile 13 includes a pair of spaced plates 56,57 having a pair of attachment openings 58,59 respectively, and a side plate 60 interconnecting the spaced plates 56,57 and having an attachment opening 61. When the window sash or door is closed, the side plate 60 faces a side jamb (not shown) that partly defines an opening in which the window sash or door is mounted. The side jamb has a recess into which the latch bolt 23 can project for locking the window sash or door.

For assembling the latch assembly 10, the bolt unit 11 is first so inserted into the opening 61 in the side plate 60 that the attachment flanges 24,25 are held against the side plate 60. The attachment flanges 24,25 are secured to the side plate 60 by means of screws (not shown) extending through the attachment screw holes into the side plate 60. Then, the bolt-driving units, 12,53 are installed on the stile 13, with the sleeve 36 inserted in the opening 58 and the sleeve 62 of the unit 53 in the opening 59. The units 12,53 are fixed to the stile 13 by means of screws (not shown).

The attachment openings 58,59 are held in mutual registry such that the bolt-driving units 12,53 upon installation have their driver torque bars 33,55 aligned with each other and with the hollow shaft 18 of the bolt unit 11 that has been mounted in place.

Usually, the bolt-driving unit 12 is mounted on the inner side of the door or sash, and the bolt-driving unit 53 on the outer side thereof. For normal latching or unlatching operation, the cylinder lock 51 is key-operated to withdraw the stop 52 from the bore 48, and the push button 46 is manually pushed into end-to-end engagement with the torque bar 33. Continued pushing of the buttom 46 is effected to allow the torque bar 33 to shift axially toward the unit 53 until the driver 42 disengages from the edge 38. Then, with the push button 46 still depressed, the handle 30 is pivoted for 90° angular movement to actuate the latch bolt 23. After actuation of the latch bolt 23, the push button 46 is released to thereby allow the driver torque bar 33 to return under the bias of the spring 45 to its equilibrium position, whereupon the driver 42 becomes engaged with the sleeve edge 38 again. Thus, manipulation of the operator handle 30 is prevented unless the push button 46 is depressed. Further, the latch bolt 23 is retained against pivotal movement from its latched or unlatched position. When it is required to lock or unlock the window sash or door from the outside thereof as in case of emergency, the knob 54 is pushed until the driver torque bar 55 forces the driver 42 out of the hollow shaft 18 against the bias of the spring 44, and then the knob 54 is turned 90° to pivot the latch bolt 23.

Unitized for compactness, the bolt unit 11 and the bolt-driving unit 12 can be installed separately with maximum ease, and no special machining other than drilling is needed on the frame member 13.

Although various minor modifications may be suggested by those versed in the art, it should be understood that I wish to embody within the scope of the patent warranted hereon, all such embodiments as reasonably and properly come within the scope of my contribution to the art.

What I claim is:

1. A latch assembly for use on a closure frame member, said latch assembly comprising:

(a) a support frame having attachment means adapted to be attached to the closure frame member;

(b) a hollow shaft mounted in said support frame and rotatable about a longitudinal axis thereof;

(c) a latch bolt fixed at one end thereof to said hollow shaft and extending radially from said hollow shaft, said latch bolt being angularly movable about said axis between a first position in which said bolt is retracted within said support frame and a second position in which said bolt has the opposite end projecting outwardly from said support frame;

(d) a casing adapted to be attached to the closure member, said casing having a bore and having fixed engagement means;

(e) a handle having a further shaft disposed in and rotatably supported by said bore in an axially fixed position;

(f) a driver torque bar having its outer end mounted coaxially in said handle-shaft and corotatable therewith and axially freely movable therein, said driver torque bar having an enlarged driver on its inner end, said driver being normally held in an angularly fixed position in response to said driver's being engaged partly with said fixed engaging means, said driver normally also extending partly into said hollow shaft in driving engagement therewith, and said driver being shiftable out of engagement with said fixed engaging means upon axial movement of said driver torque bar toward said hollow shaft to enable angular movement thereof; and (g) shifting means movably carried on said axially fixed handle for shifting said driver torque bar axially toward said hollow shaft.

2. A latch assembly according to claim 1, said hollow shaft and driver being of square cross-section.

3. A latch assembly according to claim 1, further including spring means around said driver torque bar, said spring means normally holding said driver in said angularly fixed position.

4. A latch assembly according to claim 1, said casing including a sleeve having therein a partition with a central hole through which said driver torque bar extends, said sleeve having said fixed engaging means on one end, said driver torque bar having a fixed retainer flange, and said spring means comprising a pair of compression coil springs acting between said enlarged driver and said partition, and between said retainer flange and said partition, respectively.

5. A latch assembly according to claim 4, said sleeve having an end wall with a square opening on said one end, and said fixed engaging means comprising an edge of said end wall which defines said square opening, and in which said driver is normally slidably fitted.

6. A latch assembly according to claim 1, said shifting means comprising a push button coaxial with said torque bar, said push button being movable along the axis of said torque bar and upon depression, being held in end-to-end engagement with said torque bar, and a spring acting between said torque bar and said push button to normally bias them apart.

7. A latch assembly according to claim 1, said support frame including a pair of spaced walls and an end wall interconnecting said spaced walls, and said hollow shaft extending across and through said spaced walls.

8. A latch assembly according to claim 7, further including a spring acting between said end wall and said latch bolt for maintaining said latch bolt in one of said first and second positions.

9. A latch assembly according to claim 1, including spring means acting on said driver torque bar in the direction of its axis, said spring means including a pair of oppositely acting springs jointly holding said driver torque bar in an equilibrium position in which said driver is in said angularly fixed position.

* * * * *